US010259677B2

(12) United States Patent
Lillich et al.

(10) Patent No.: US 10,259,677 B2
(45) Date of Patent: Apr. 16, 2019

(54) AUTOMATIC CABLE SPOOLING DEVICE

(71) Applicants: Adam Lillich, Bossier City, LA (US); James M. Leslie, Shreveport, LA (US)

(72) Inventors: Adam Lillich, Bossier City, LA (US); James M. Leslie, Shreveport, LA (US)

( * ) Notice: Subject to any disclaimer, the term of this patent is extended or adjusted under 35 U.S.C. 154(b) by 0 days.

(21) Appl. No.: 15/277,441

(22) Filed: Sep. 27, 2016

(65) Prior Publication Data

US 2017/0088388 A1 Mar. 30, 2017

Related U.S. Application Data

(60) Provisional application No. 62/233,367, filed on Sep. 27, 2015.

(51) Int. Cl.
*B65H 54/28* (2006.01)

(52) U.S. Cl.
CPC ..... *B65H 54/2827* (2013.01); *B65H 54/2848* (2013.01)

(58) Field of Classification Search
CPC ..... B65H 54/2827; B65H 54/2848; B65H 54/2854; B65H 54/2869; B65H 54/2872
See application file for complete search history.

(56) References Cited

U.S. PATENT DOCUMENTS 1,961,668 A * 6/1934 Kaufman ..... B21C 47/12 242/395
5,957,000 A * 9/1999 Pecorari ..... F16C 33/78 74/425
6,264,128 B1 * 7/2001 Shampine ..... B65H 54/2827 242/157.1
2001/0042808 A1 * 11/2001 Klaus ..... B65H 54/2827 242/483.8
2003/0006034 A1 * 1/2003 Neal ..... B65H 75/4402 166/77.2
2004/0021031 A1 * 2/2004 Klaus ..... B65H 54/2827 242/483.8
2009/0186565 A1 * 7/2009 Memmelaar, Sr. ..... B24B 7/12 451/332

FOREIGN PATENT DOCUMENTS

DE 102014001134 A1 * 7/2015 ..... B65H 54/2851
WO WO-2015113762 A1 * 8/2015 ..... B65H 54/2851

* cited by examiner

*Primary Examiner* — William E Dondero
(74) *Attorney, Agent, or Firm* — Warner J. Delaune; Baker Donelson, et al.

(57) ABSTRACT

An automatic cable spooling device is provided, comprising a frame adapted to rotatably hold a spooling drum; a drum motor operatively connected to the drum; and a levelwind arm positioned adjacent to the drum. The levelwind arm is movable in a plane aligned with the rotational axis of the drum. The system further includes an arm motor operatively connected to the levelwind arm; and a microcontroller in communication with the arm motor. An arm encoder is adapted to sense a position of the arm motor and is in communication with the microcontroller. Likewise, a drum encoder is adapted to sense a position of the drum motor and is also in communication with the microcontroller. The position of the levelwind arm is controlled by the microcontroller based on the position of the drum, the spooling width, and a predetermined cable diameter.

12 Claims, 10 Drawing Sheets

AUTOMATIC CABLE SPOOLING DEVICE

CROSS-REFERENCE TO RELATED APPLICATIONS

This nonprovisional application claims priority to U.S. Ser. No. 62/233,367, filed on Sep. 27, 2015.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The invention relates generally to devices and methods used to automatically and evenly spool cable, wire, line or lead rope, and more particularly to such devices and methods used to pull conductors in the electrical utility field.

2. Description of Related Art

Automatic spooling of cable on a drum for conductor pullers is usually done with a self-reversing leadscrew. This is a mechanical means to traverse a spooling head linearly back and forth similar to the manner in which fishing line is spooled on a bait casting reel. The linear speed of the spooling head is proportional to the rotational speed of the drum, where the drum and leadscrew are mechanically linked by a chain. Properly sizing the chain reduction, leadscrew pitch, and leadscrew groove length will spool the cable onto the drum somewhat evenly. However, since the prior art methods are a mechanical solution to proper spooling, all components must be designed, machined and assembled perfectly for it to work correctly. If the cable is not spooled properly, then cable life is decreased due to increased frictional wear and the machine will not work properly. Leadscrews require many parts that are quickly wearable and require frequent maintenance. Furthermore, the leadscrew is typically designed for one specific cable diameter. Therefore, if one cable is exchanged for another, or if the cable shrinks due to stretching, the leadscrew will not work properly, and a new leadscrew system needs to be installed. Also, because of the chain linking the leadscrew to the drum, the leadscrew may not be moved independently of the drum.

Accordingly, what is needed is an improved method and device for automatically spooling cable, wire, line or lead rope on a drum which accomplishes at least the following objectives: (1) automatic cable spooling on the drum with a powered levelwind arm; (2) use of a controller to gauge drum speed and conversion to the appropriate levelwind movement based on the drum flange width and cable diameter; (3) use of a slew bearing and worm gear to support movement of the levelwind arm; (4) use of an encoder in the drum driveline to assist in establishing the proper cable position; and (5) use of an encoder on the worm gear for establishing the actual cable position.

SUMMARY OF THE INVENTION

An automatic spooling system is provided in a preferred embodiment, comprising a frame adapted to rotatably hold a spooling drum, wherein the spooling drum includes a rotational axis, and a spooling width bounded by a first flange and a second flange; a drum motor operatively connected to the drum; a levelwind arm positioned adjacent to the drum, wherein the levelwind arm is moved in a plane aligned with the rotational axis of the drum; an arm motor operatively connected to the levelwind arm; an arm encoder in communication with the arm motor; a microcontroller in communication with the arm motor; an arm encoder adapted to sense a position of the arm motor and in communication with the microcontroller; a drum encoder adapted to sense a position of the drum motor and in communication with the microcontroller; and wherein the position of the levelwind arm is controlled by the microcontroller based on the position of the drum, the spooling width, and a predetermined cable diameter.

In a further embodiment, the levelwind arm includes a plurality of sheaves adapted to guide a cable from a cable source into the drum.

In another embodiment, the levelwind arm may be mounted to a slew bearing adapted to allow pivoting motion of the levelwind arm within the plane.

The slew bearing includes a central opening for passage of a cable, and the arm motor is operatively connected to the slew bearing through a worm and worm gear system.

The drum encoder is adapted to identify a required cable position, and the arm encoder is adapted to identify an actual cable position.

In a further embodiment, the spooling system also includes a display in communication with the microcontroller adapted to receive input from an operator of parameters required to achieve an optimum wind of a cable around the drum.

A method of spooling a cable is also provided, comprising the steps of providing a spooling system as explained above; setting a plurality of parameters in the microcontroller based on a position of the drum, the spooling width, and a predetermined cable diameter; and operating the spooling system to spool the cable.

The above and other objects and features of the present invention will become apparent from the drawings, the description given herein, and the appended claims.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

As will be further described below with respect to the preferred embodiment, the present invention automatically and evenly spools cable onto a drum regardless of variations in cable size or other external factors. The system uses electronics to replace mechanical means of automatic spooling. Generally, a cable enters through the pivoting axis of a slew bearing and is directed through a plurality of sheaves onto a drum. A levelwind arm is driven back and forth based on a closed loop feedback system that relates the proper cable position to its actual position. The proper position of the cable is a function of variable drum rotation, drum width, and cable diameter. The drum and cable parameters may be modified at any time to accommodate the specifics of the spooling environment.

Figure 1:
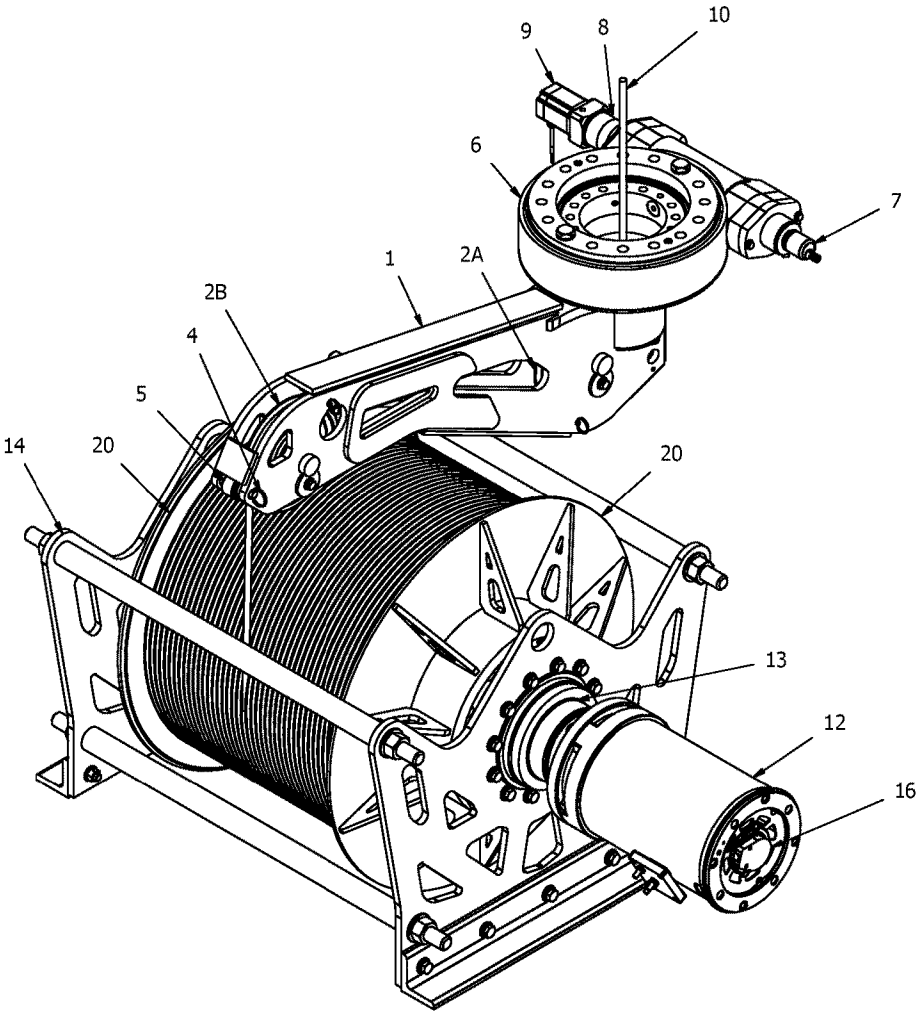
FIG. 1 illustrates a perspective view of a preferred embodiment of the present invention in the form of an automatic cable spooling device.
Figure 2A:
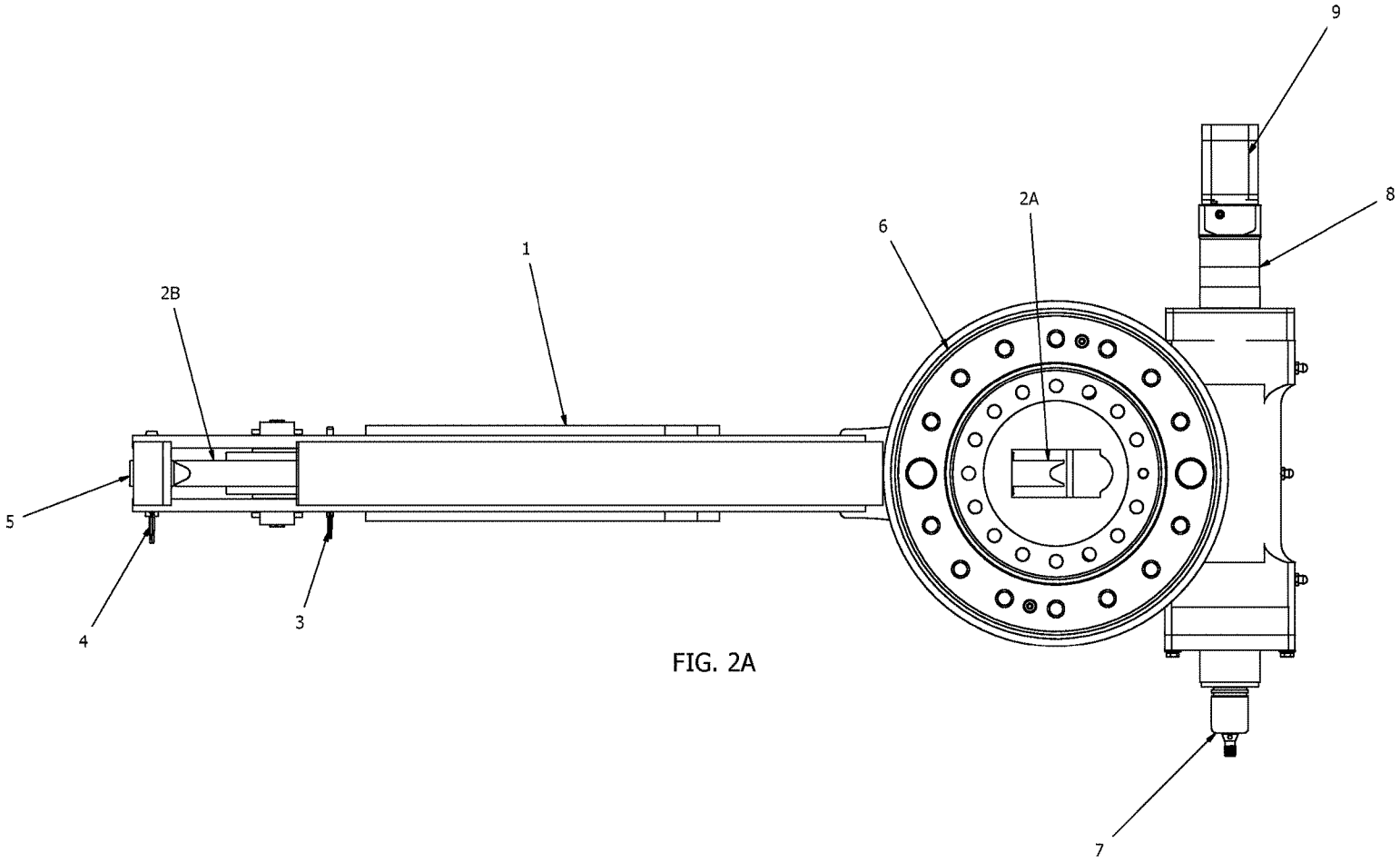
FIGS. 2A-2C illustrate top, side, and perspective views of the subassembly containing the levelwind arm, slew bearing, slew motor and drive, and the encoder.
Figure 2B:
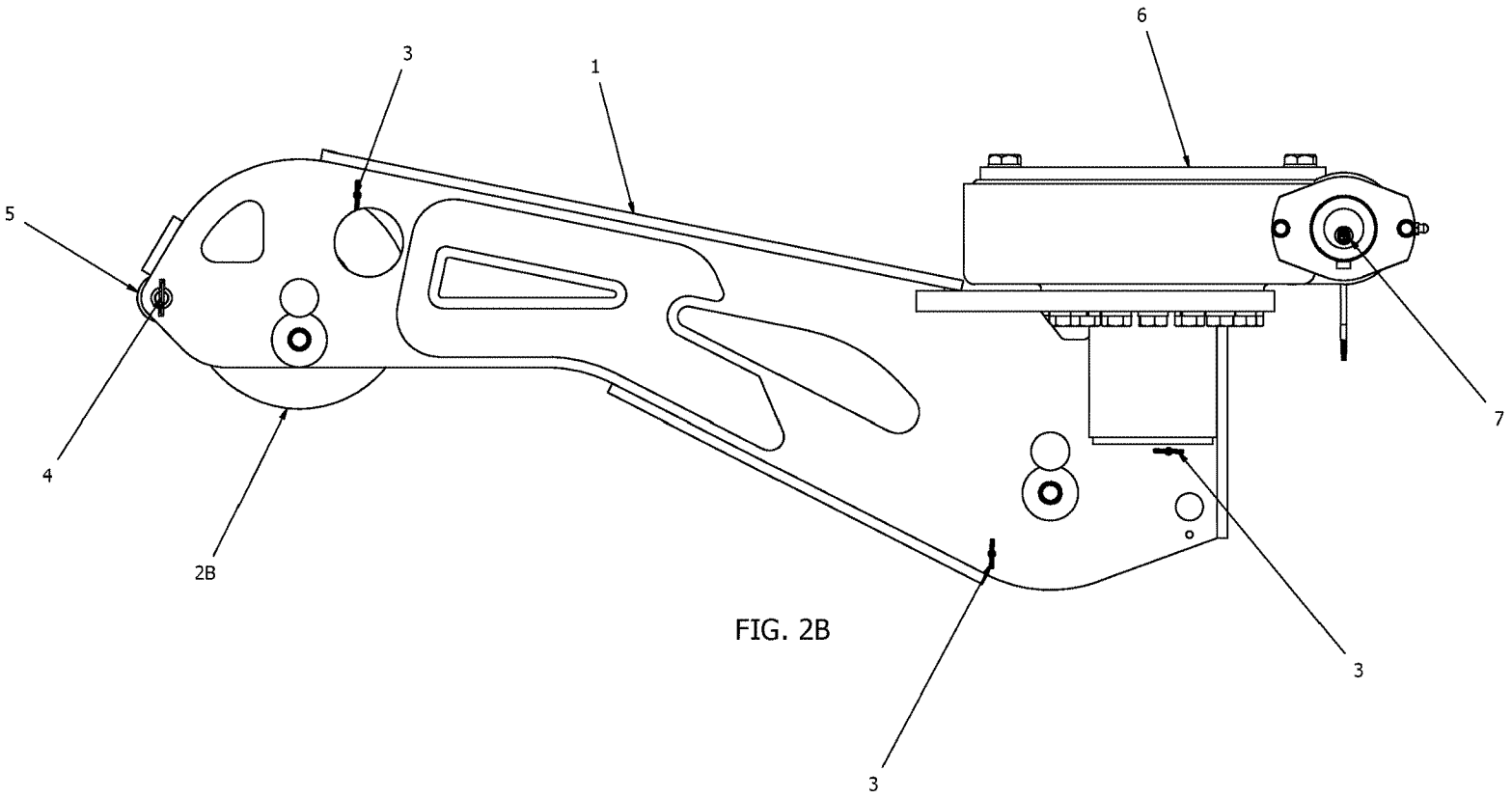
Figure 2C:
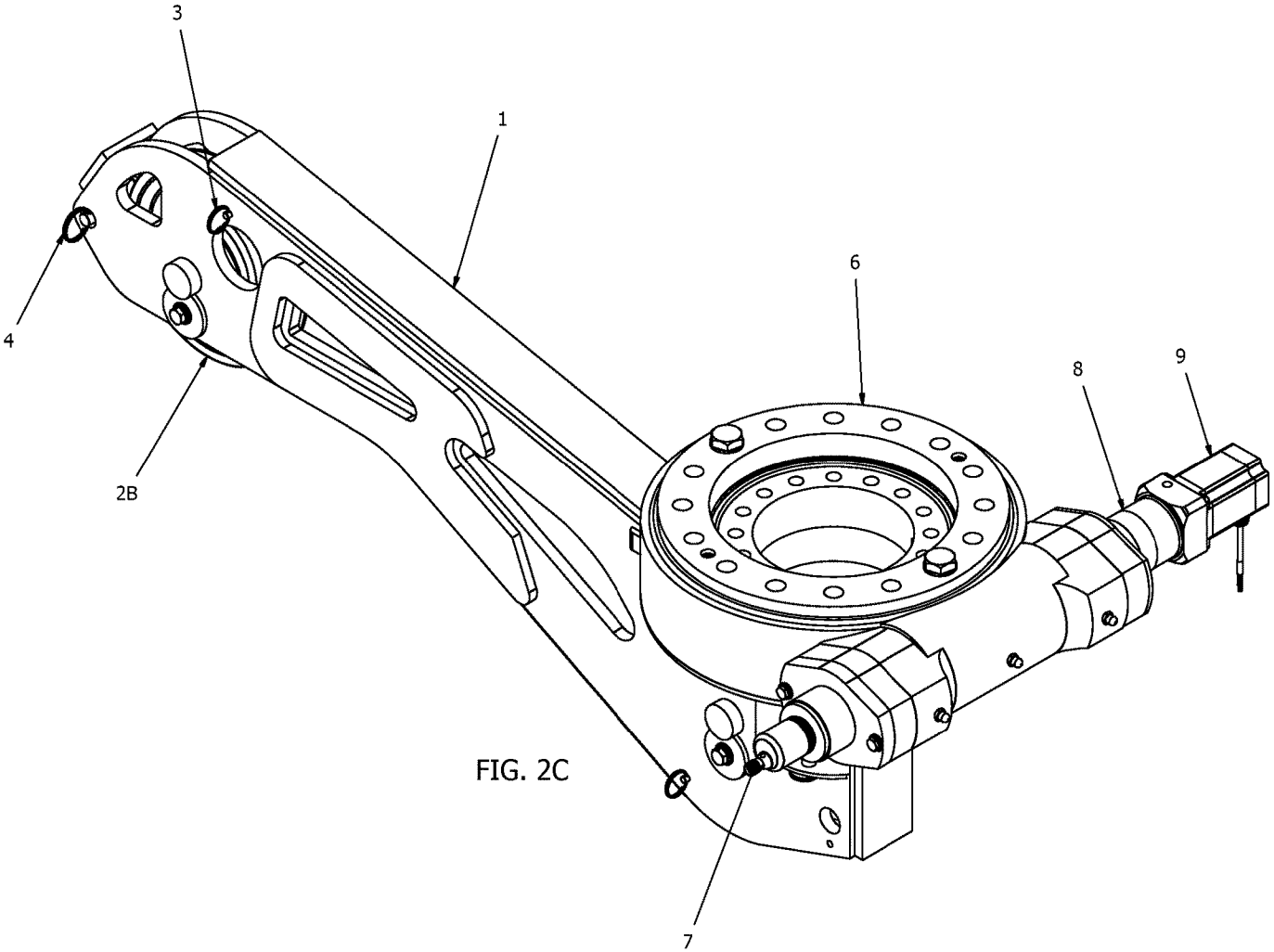

In the preferred embodiment shown in FIG. 1, the automatic cable spooler of the present invention comprises a levelwind arm 1 having a first sheave 2A positioned below a slew bearing 6, and a second sheave 2B positioned directly above a drum 11. The levelwind arm 1 is rotatably mounted below the slew bearing 6, while the slew bearing 6 is mounted to a spooler frame 40 as will be described elsewhere with respect to FIGS. 5A-5C. As will be appreciated, the slew bearing 6 must be suitably strong to support high axial loads and similar forces from the levelwind arm 1 during spooling activities. A cable 10 is routed through the center of the slew bearing 6, around the first sheave 2A, around the second sheave 2B, and then onto the drum 11. Two guide pins 3 are positioned behind the first sheave 2A, and a guide pin 3 and track roller 5 are positioned in front of the second sheave 2B to ensure that the cable 10 remains securely within the second sheave 2B. For the purposes of this application, the word cable shall be used, with the understanding that the invention applies equally to cables, ropes (including lead ropes to pull electrical cables), wires, and any other flexible lines which can be spooled around a drum 11.

The slew bearing 6 includes worm gear and worm system 8 operatively attached to the slew bearing 6 for causing the levelwind arm 1 to pivot back and forth as will be further described. A slew motor 9 is operatively connected to the worm drive 8, along with a slew encoder 7 and a microcontroller 17 (such as a programmable logic controller, or PLC, having data storage and memory functionality), as further depicted in FIG. 7. The slew encoder 7 can be an incremental or absolute encoder and is either mounted on the opposite side of the worm gear or to an auxiliary shaft on the slew motor 9. As will be explained elsewhere, the slew encoder detects and communicates to the microcontroller 17 the absolute position of the worm drive 8, which can be correlated to the position of the cable 10 exiting the second sheave 2B on the levelwind arm 1. Alternatively, a linear actuator with a linear distance transducer may be used to rotate the levelwind arm 1 about the slew bearing 6. In another possible embodiment, the levelwind arm 1 may be driven entirely by a linear actuator or equivalent motor and drive system that moves the levelwind arm 1 in a purely linear path relative to the drum 11, rather than the slightly arcuate path enabled by the slew bearing 6 shown in the figures. In either case, however, control of the position of the levelwind arm 1 based on the parameters described herein and the method of achieving consistent levelwind results is within the scope of the present invention.

The drum 11 includes side flanges 20 which are rotatably positioned within a drum frame 14. A drum motor 12, and typically a drum gear box 13 to increase drum motor torque, are operatively connected to the drum frame 14 and the drum 11 to rotate the drum 11 and spool the cable 10. The drum motor 12 includes a drum encoder 16, as further depicted in the schematic diagram of FIG. 7.

The microcontroller 17 is initialized by the operator with the beginning position of the cable 10 on the drum 11. As the drum 11 turns, the microcontroller 17 relates the drum encoder 16 pulses to the proper position of the cable 10 based on the particular characteristics of the cable 10 and drum 11 that are input into the microcontroller 17 via the display 30 on the cable spooler. The microcontroller 17 also receives positional data from the slew encoder 7 and calculates the actual position of the cable 10. The microcontroller 17 then outputs signals to the slew motor 9 to move the levelwind arm 1 until the actual cable position equals the proper cable position, thus completing a closed loop feedback system. Inputs to the microcontroller 17, such as drum width, cable diameter, and calibrated position function, may be modified at any time using the display 30.

Figure 7:
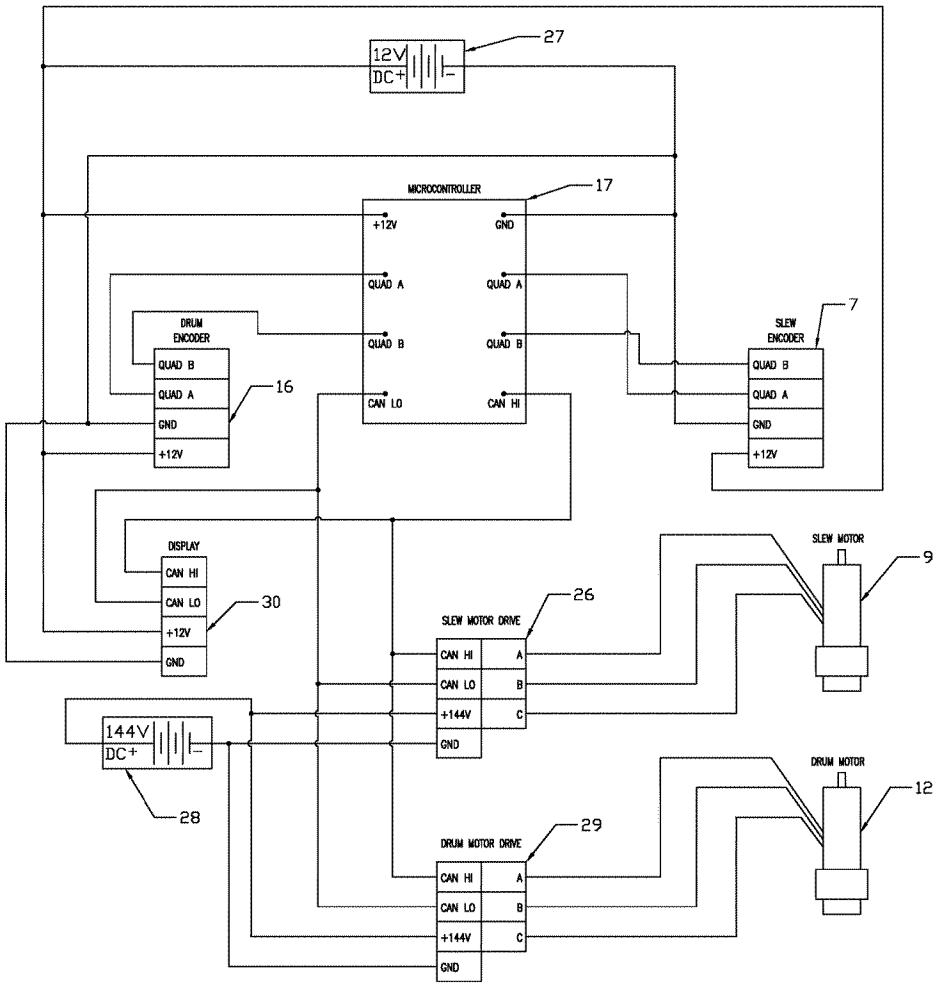
FIG. 7 is a schematic diagram showing the power connections and communication between the slew and drum motors, slew and drum encoders, and the microcontroller.

With reference to FIG. 7, the microcontroller 17 bidirectionally communicates to the slew motor drive 26, the drum motor drive 29, and the display 30 over the CanBus with CanOpen, a digital communication protocol utilizing two channels, Can Hi and Can Lo. The user inputs desired drum 11 speed with the display 30, which information is sent to the microcontroller 17, and which is then filtered based on limiting parameters and finally sent to the drum drive 29 to carry out the motion desired. The actual movement of the drum motor 12 is communicated to the microcontroller 17 from the drum encoder 16 through quadrature pulses which can be translated into direction, position, speed and acceleration. The microcontroller 17 sends this information to the PID controller which then outputs a slew motor 9 speed that is sent to the slew motor drive 26. Information attained from the slew motor drive 26, drum motor drive 29, slew encoder 7, and drum encoder 16 are then passed from the microcontroller 17 to the display 30 for the user to see.

In operation, to achieve the levelwind output position during spooling, an operator uses the display 30 to input the drum 11 width between the drum flanges 20. Generally, this is accomplished by defining six positions of the levelwind arm 1 between one drum flange 20 to the other drum flange 20. First, the operator is prompted by the display 30 to manually move the levelwind arm 1 until the center of the second sheave 2B is directly over the first flange (left or right). With the second sheave 2B and the level wind arm 1 in this initial position, the operator presses a button on the display 30 which records the corresponding slew encoder 7 position in the microcontroller 17. The operator is then prompted to manually move the levelwind arm 1 until the center of the second sheave 2B is one-fifth of the way between the two drum flanges 20. With the levelwind arm 1 the second position, the operator presses a button on the display 30 which records the corresponding slew encoder 7 position in the microcontroller 17. This sequential process of moving the level wind arm 1 and recording the position via the display 30 is repeated for each position at successive one-fifth distances from the initial drum flange 20 until the sixth and final position of the levelwind arm 1 is recorded at the second drum flange 20.

At this point, the microcontroller 17 has six points to plot a position profile. Between each point, the profile curve is linearized for simplification, because the error is small enough to neglect. The foregoing steps have now correlated the slew encoder 7 output to the levelwind arm 1 output position. To define the cable 10 position, the operator uses the display 30 to input the desired number of wraps on the drum 11 per layer into the microcontroller 17. The operator also inputs the pulses per revolution of an incremental drum encoder 16. The microcontroller 17 then calculates the total number of pulses per cable layer as well as the number of pulses per wrap. As the cable 10 enters and is aligned with the initial drum flange 20 and is tangent to the drum 11 from the levelwind arm 1 output sheave 2B, the operator uses the display 30 to input this position as the starting point of the cable 10. At this position, the microcontroller 17 resets its counts to zero. As the drum 11 turns, the drum encoder 16 outputs pulses to the microcontroller 17. One full revolution of the drum 11 means the cable 10 should move exactly one wrap (or cable diameter) over, causing movement of the levelwind arm 1 to achieve this outcome. The spooling of the cable 10 continues until the total number of pulses per layer have been achieved, which is indicative that the cable 10 has completed a full layer and reached the opposite drum flange 20, and now needs to travel back toward the initial drum flange 20 in half-wrap increments.

At this point in the spooling process, each pulse from the drum encoder 16 is subtracted from the cumulative pulse count tracked by the microcontroller 17. This continues until the pulse count reaches zero, indicating that the cable 10 has returned to the initial drum flange 20 and needs to change directions. Now that both the proper cable 10 position (cable position) and the actual cable 10 position (levelwind output position) are known by the microcontroller 17, a closed loop feedback system can be used. For example, a proportional-integral-derivative (PID) feedback loop can be employed, where two variables (actual position and proper position) are present, and the controller calculates the error, or simply the difference, between the two variables. The controller also accepts constants such as proportional gain factor, integral gain factor, differential gain factor and min/max output values. The controller calculates the proportional, integral and differential of the error and multiplies each respective gain. The output of the controller is the sum of each of these except when they exceed the minimum or maximum values. When this system is in action, the levelwind arm 1 will always place the cable 10 in the proper position to wrap each layer on the drum 11. Reversing the rotating direction of the drum 11 is easily accommodated by changing the pulse count direction. If a smaller or larger cable 10 is desired, the new number of wraps is entered via the display 30 into the microcontroller 17.

Figure 4A:
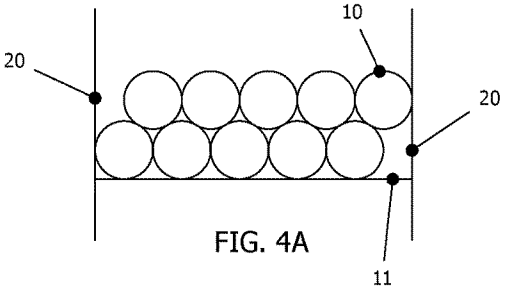
FIGS. 4A and 4B illustrate the manner in which the cable should be properly spooled on the drum using the present invention.
Figure 4B:
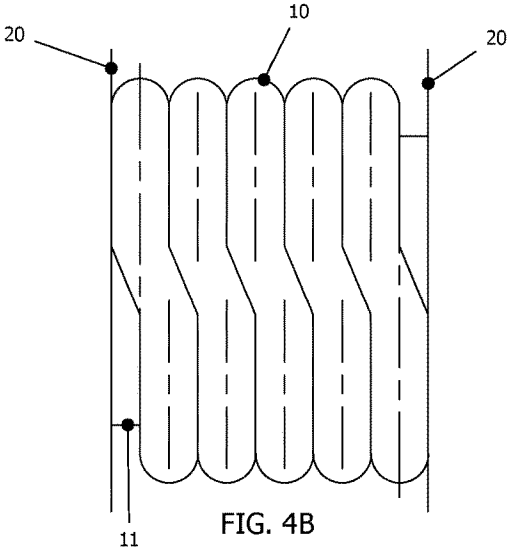
Figure 3:
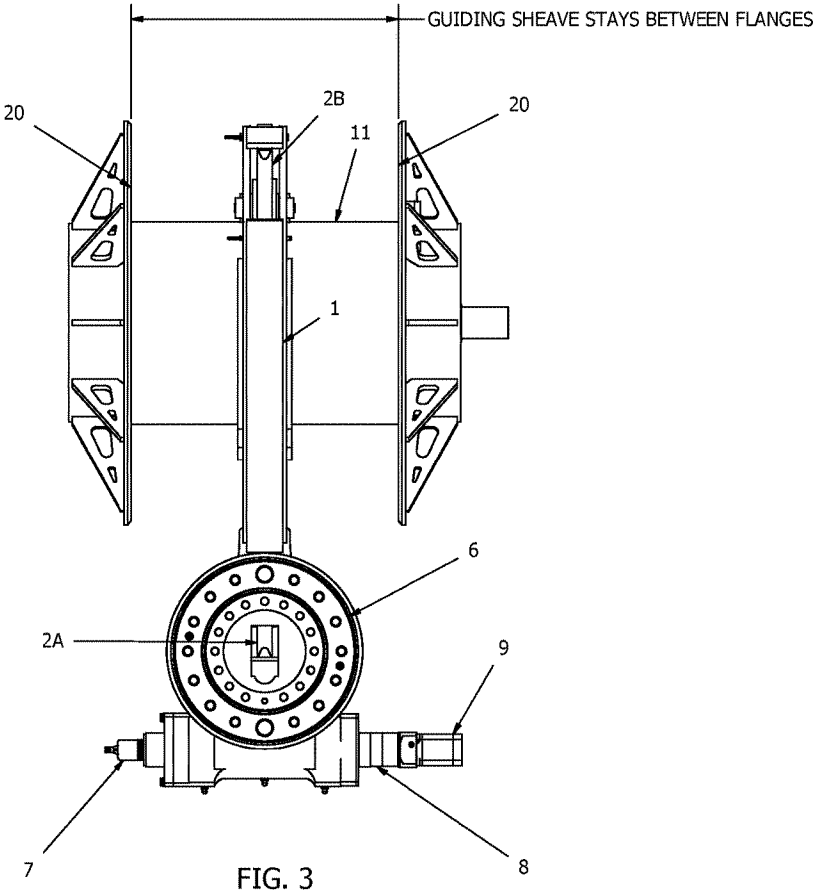
FIG. 3 illustrates a top view of the levelwind arm and guiding sheave relative to the drum flanges.

FIGS. 4A and 4B illustrate a proper spooling orientation of the cable 10 around the drum 11, wherein the cable 10 is wound in parallel half-wraps. Spooling on a drum 11 is best achieved by wrapping the cable 10 as close to parallel with the drum flanges 20 as possible. Because the wraps can only stay parallel for up to 360 degrees, the cable 10 must be shifted over in certain increments. For drums 11 around 14 inches in diameter and with cable 10 of one-half inch in diameter, shifting the cable 10 by one-half of the cable diameter at 180 degree increments works best. FIG. 4B shows how one layer should ideally be wrapped. As the drum 11 turns beyond this layer, the cable 10 will be forced up to the next layer and continue to lay on the previous layer except offset by one-half of the cable diameter as seen in the cross-sectional view of FIG. 4A.

To achieve parallel wraps, the levelwind arm 1 must be positioned directly in line and create a zero degree fleet angle between the sheave 2B and correct cable wrap position on the drum 11. The levelwind arm 1 will remain in this position until the drum 11 has rotated 180 degrees. At this point the microcontroller 17 establishes that the levelwind arm 1 must be moved until the "actual" levelwind arm 1 position equals the "proper" levelwind arm 1 position. As explained above, this result is achieved by a PID feedback loop where the error is calculated as the difference between the actual position and the proper position. The slew motor 9 speed and direction are determined by the output of PID loop. Once the error between the actual position and the proper position equals zero, the drum motor 12 will remain in that position until the next half-wrap position is requested.

Figure 5A:
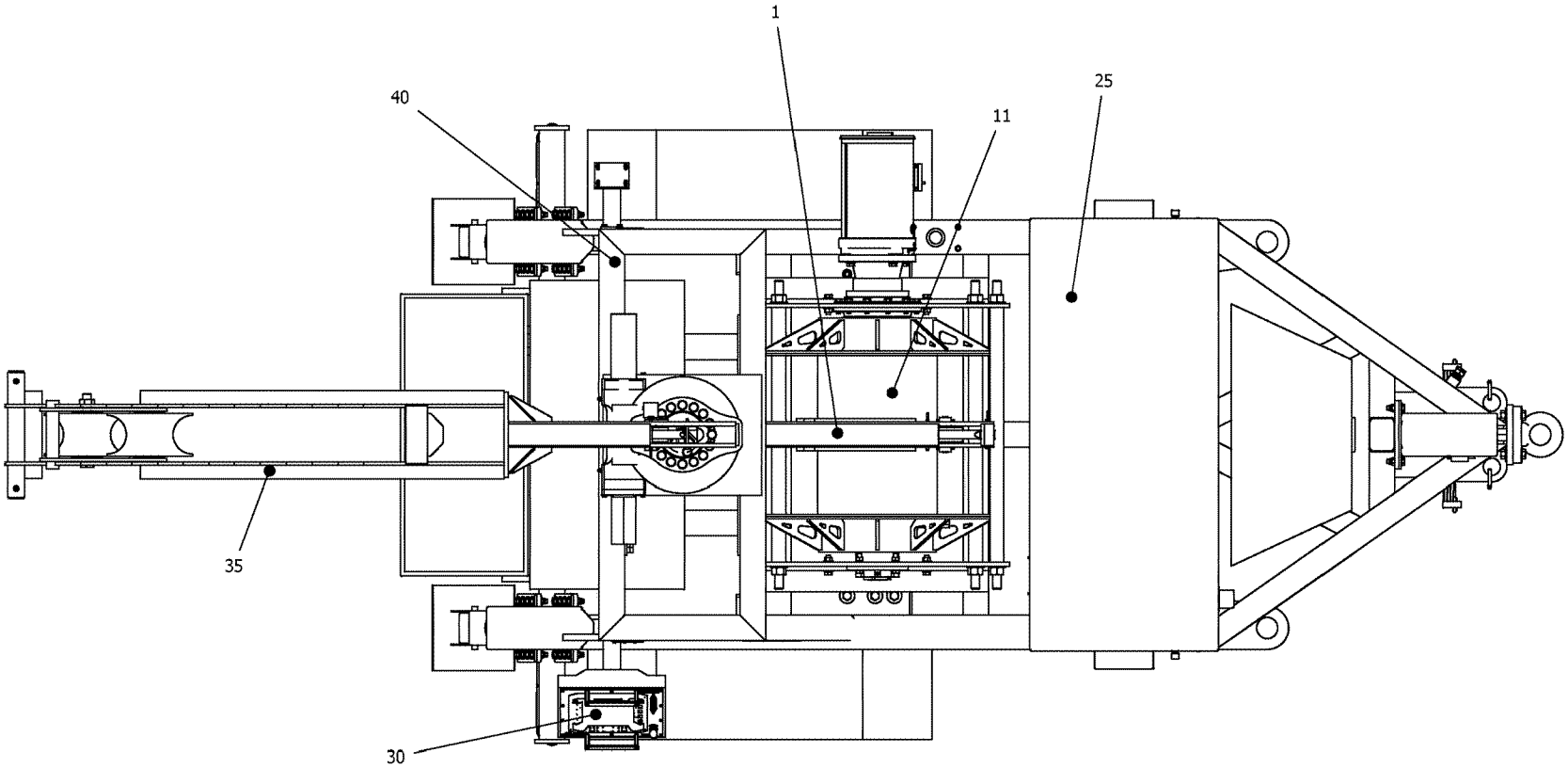
FIGS. 5A-5C illustrate top, side, and perspective views of a cable pulling device which incorporates a preferred embodiment of the present invention.
Figure 5B:
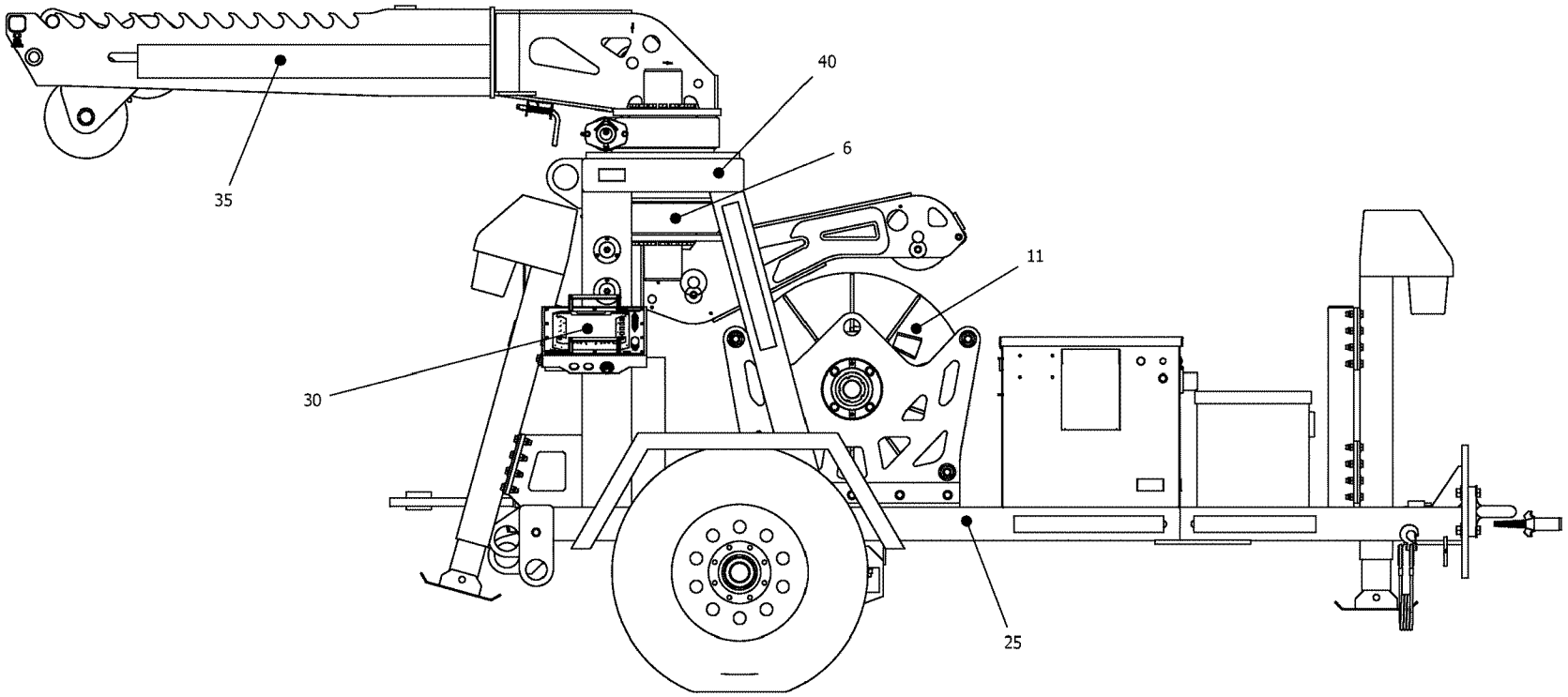
Figure 5C:
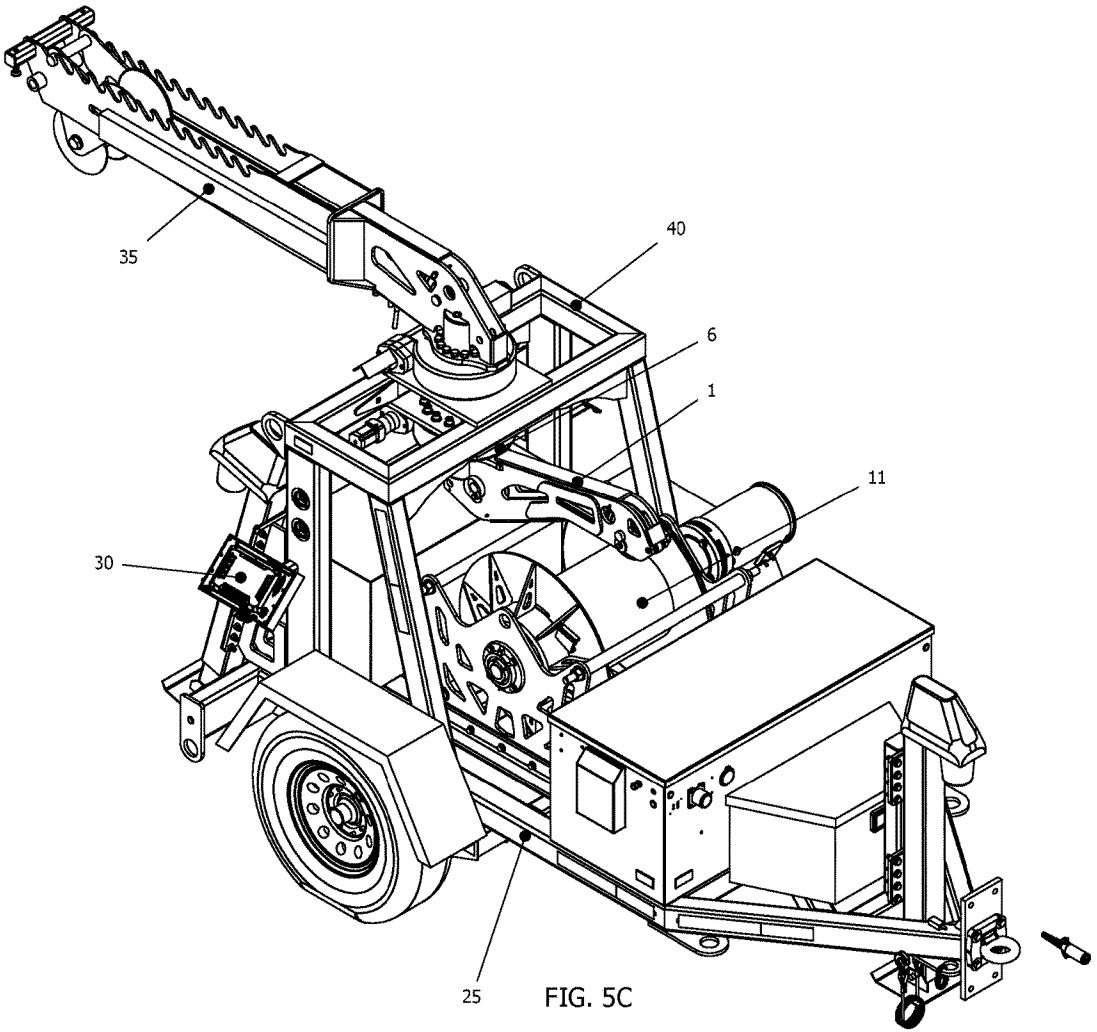

The above described spooling system may be used in a wide range of spooling applications. However, in a preferred embodiment, the spooling system can be incorporated into a larger machine designed for pulling conductor for electrical services. As shown in FIGS. 5A-5C, a mobile, battery-powered winch is depicted as having a wheeled platform 25 and an upper frame 40. The spooling system of the present invention is operatively attached to the frame 40 by mounting the upper portion of the slew bearing 6 to the frame 40, while the drum frame 14 is mounted to the wheeled platform 25. A conductor pulling arm 35, usually referred to as a "boom" or "rear boom", having appropriate sheaves and features allowing adjustment of length is also pivotally attached to the upper frame 40.

Figure 6:
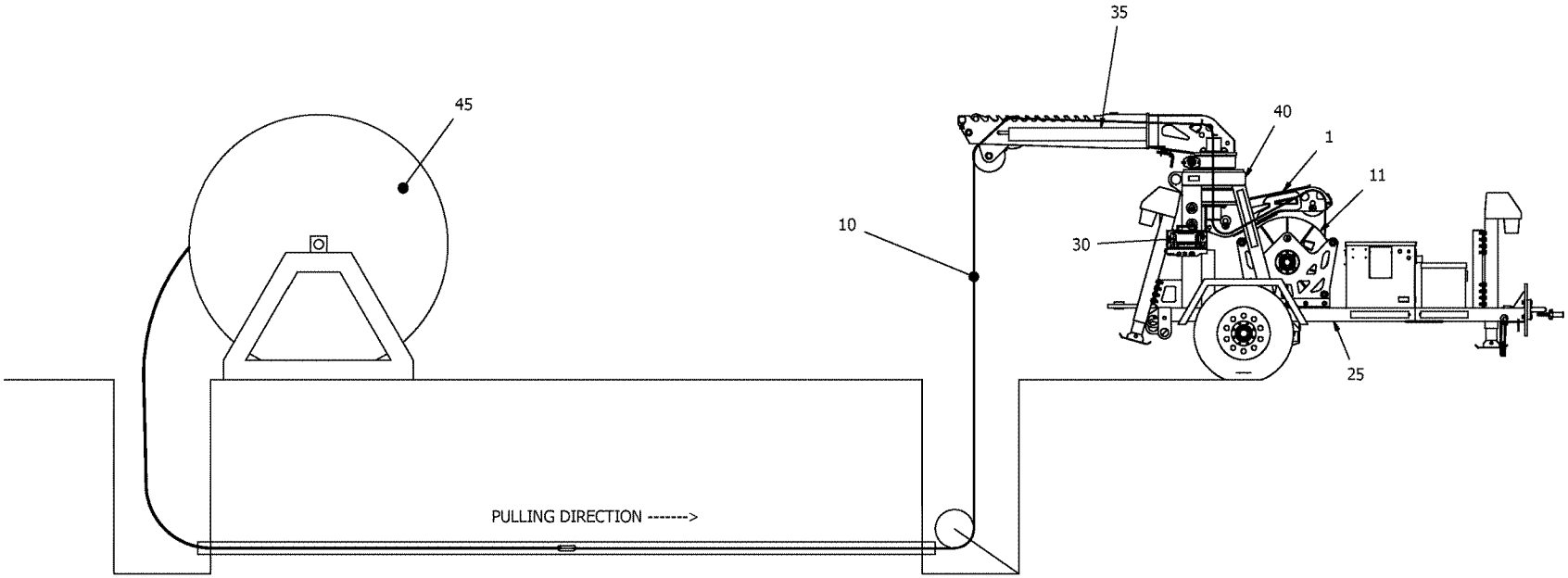
FIG. 6 illustrates the cable pulling device of FIGS. 5A-5C in position to pull a cable through a conduit.

In operation, and as shown in FIG. 6, the mobile winch is positioned to pull a cable 10 through an underground conduit from a remote source conductor spool 45. In typical cases, a pilot line (not shown) has been preinstalled within the conduit when the conduit was buried. This pilot line is used to pull the cable 10 from the mobile winch to the conductor end 45. If the pilot line was not preinstalled, the pilot line may be blown with a compressor from the conductor end 45 to the cable end 10. Once the pulling cable 10 has reached the conductor 45 end, the conductor 45 and the cable 10 are attached together with a swivel. The mobile winch then applies electrical power to the electric drum motor 12 to pull the cable 10 until the conductor 45 reaches the pulling end. The cable 10 is then detached from the conductor 45 and another pull may be made through a different conduit.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. An automatic spooling system, comprising:

a frame adapted to rotatably hold a spooling drum, wherein the spooling drum includes a rotational axis, and a spooling width bounded by a first flange and a second flange;

a drum motor operatively connected to the drum;

a levelwind arm positioned adjacent to the drum, wherein the levelwind arm is mounted to a single slew bearing adapted to allow pivoting motion of the levelwind arm in a plane aligned with the rotational axis of the drum, and wherein the slew bearing has a central opening for passage of a cable;

an arm motor operatively connected to the levelwind arm, wherein the arm motor is operatively connected to the slew bearing through a worm and worm gear system;

a microcontroller in communication with the arm motor;

an arm encoder adapted to sense a position of the arm motor and in communication with the microcontroller;

a drum encoder adapted to sense a position of the drum motor and in communication with the microcontroller; and wherein the position of the levelwind arm is controlled by the microcontroller based on the position of the drum, the spooling width, and a predetermined cable diameter.

2. The spooling system of claim 1, wherein the levelwind arm includes a plurality of sheaves adapted to guide the cable from a cable source into the drum.

3. The spooling system of claim 1, wherein the drum encoder communicates a position of the drum motor through the microcontroller to identify a required cable position.

4. The spooling system of claim 1, wherein the arm encoder is adapted to identify an actual cable position.

5. The spooling system of claim 1, further including a display in communication with the microcontroller adapted to receive input from an operator of parameters required to achieve an optimum wind of a cable around the drum.

6. The spooling system of claim 1, wherein the levelwind arm is controlled to spool the cable in half-wrap increments relative to a preceding wind of the cable around the spool.

7. A method of spooling a cable, comprising the steps of:

providing a spooling system comprising:

a frame adapted to rotatably hold a spooling drum, wherein the spooling drum includes a rotational axis, and a spooling width bounded by a first flange and a second flange;

a drum motor operatively connected to the drum;

a levelwind arm positioned adjacent to the drum, wherein the levelwind arm is mounted to a single slew bearing adapted to allow pivoting motion of the levelwind arm in a plane aligned with the rotational axis of the drum, and wherein the slew bearing has a central opening for passage of a cable;

an arm motor operatively connected to the levelwind arm, wherein the arm motor is operatively connected to the slew bearing through a worm and worm gear system;

a microcontroller in communication with the arm motor;

an arm encoder adapted to sense a position of the arm motor and in communication with the microcontroller;

a drum encoder adapted to sense a position of the drum motor and in communication with the microcontroller; and wherein the position of the levelwind arm is controlled by the microcontroller based on the position of the drum, the spooling width, and a predetermined cable diameter;

setting a plurality of parameters in the microcontroller based on the position of the drum, the spooling width, and the predetermined cable diameter; and operating the spooling system to spool the cable.

8. The method of claim 7, wherein the levelwind arm includes a plurality of sheaves adapted to guide a cable from a cable source into the drum.

9. The method of claim 7, wherein the drum encoder communicates a position of the drum motor through the microcontroller to identify a required cable position.

10. The method of claim 7, wherein the arm encoder is adapted to identify an actual cable position.

11. The method of claim 7, further including a display in communication with the microcontroller adapted to receive input from an operator of parameters required to achieve an optimum wind of a cable around the drum.

12. The method of claim 7, wherein the levelwind arm is controlled to spool the cable in half-wrap increments relative to a preceding wind of the cable around the spool.

* * * * *